US009943732B2

(12) United States Patent
Jacaman et al.

(10) Patent No.: US 9,943,732 B2
(45) Date of Patent: Apr. 17, 2018

(54) GOLF CLUB WITH VISUAL FEATURE INDICATOR

(71) Applicant: NIKE, Inc., Beaverton, OR (US)

(72) Inventors: Jamil Jacaman, Fort Worth, TX (US); Michael G. Taylor, Granbury, TX (US); Nate Radcliffe, Trophy Club, TX (US); Matt Daraskavich, Grapevine, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/225,075

(22) Filed: Aug. 1, 2016

(65) Prior Publication Data

US 2018/0028876 A1 Feb. 1, 2018

(51) Int. Cl.
*A63B 53/02* (2015.01)
*A63B 53/04* (2015.01)

(52) U.S. Cl.
CPC ..... *A63B 53/02* (2013.01); *A63B 53/047* (2013.01); *A63B 2053/0441* (2013.01)

(58) Field of Classification Search
CPC ..... A63B 53/02; A63B 53/047; A63B 2053/0441
USPC ..... 473/305–315, 219–256
See application file for complete search history.

(56) References Cited

U.S. PATENT DOCUMENTS 2,299,735 A * 10/1942 Birkhofer ..... A63B 53/02 473/309
3,410,558 A * 11/1968 Reuter, Jr. ..... A63B 53/02 403/292
3,703,290 A * 11/1972 Wilson ..... A63B 59/50 273/DIG. 2
3,759,517 A * 9/1973 Mills ..... A63B 53/02 473/306
4,063,737 A * 12/1977 Tom ..... A63B 53/02 473/311
4,854,583 A * 8/1989 Kobayashi ..... A63B 53/02 403/292
5,181,720 A * 1/1993 Stites, III ..... A63B 53/02 473/312
5,205,553 A * 4/1993 Okumoto ..... A63B 53/02 473/312
5,257,807 A * 11/1993 Baumann ..... A63B 53/007 473/312
5,380,005 A * 1/1995 Hsu ..... A63B 53/02 473/311

(Continued)

*Primary Examiner* — Sebastiano Passaniti

(57) ABSTRACT

A golf club having improved visual feature recognition includes a golf club head coupled to a golf club shaft. The golf club head includes a hosel defining a bore, a sole, and a design attribute that is generally not capable of easy visual discernment. The bore has a first portion having a first diameter, a second portion having a second diameter that is smaller than the first diameter, and a transition from the first diameter to the second diameter. The bore extends through the golf club head to the sole, and the golf club shaft is disposed within the first portion of the bore and secured to the hosel. A polymeric plug is disposed within the bore between the golf club shaft and the sole. The polymeric plug includes a restraining feature that contacts the transition to prevent withdrawal of the polymeric plug through the sole, and is a color that corresponds to the design attribute.

15 Claims, 2 Drawing Sheets

(56) References Cited

U.S. PATENT DOCUMENTS

| | | | | |
|---|---|---|---|---|
| 5,540,435 | A * | 7/1996 | Kawasaki | A63B 53/02 473/309 |
| 6,088,947 | A * | 7/2000 | Suzue | A01K 87/00 280/819 |
| 6,231,455 | B1 * | 5/2001 | Chang | A63B 53/02 473/314 |
| 6,270,425 | B1 * | 8/2001 | Dyer | A63B 53/02 473/307 |
| 6,431,995 | B1 * | 8/2002 | Jackson | A63B 53/04 473/305 |
| 6,769,994 | B2 * | 8/2004 | Boone | A63B 53/02 473/245 |
| 6,855,067 | B2 * | 2/2005 | Solheim | A63B 53/02 473/246 |
| 6,923,734 | B2 * | 8/2005 | Meyer | A63B 53/047 473/336 |
| 2004/0198530 | A1 * | 10/2004 | Poynor | A63B 53/02 473/305 |
| 2004/0235582 | A1 * | 11/2004 | Solheim | A63B 53/02 473/308 |
| 2005/0043111 | A1 * | 2/2005 | Albert | A63B 53/04 473/324 |
| 2005/0101402 | A1 * | 5/2005 | Kawakami | A63B 53/0466 473/305 |
| 2015/0367185 | A1 * | 12/2015 | Vrska | A63B 53/02 473/305 |

* cited by examiner

GOLF CLUB WITH VISUAL FEATURE INDICATOR

TECHNICAL FIELD

The present invention relates generally to a golf club that includes a polymeric plug that provides improved visual feature recognition.

BACKGROUND

Golf club designs can often be a complex balance of loft angles, sole profiles, metal types, mass distribution profiles, and face design and fabrication. Certain designs may play to certain golfer's strengths, while other designs may be subjectively or objectively disfavored. These design attributes, however, can be difficult to quantify, and thus are often only generally referenced using marketing terminology, which may not be easily distinguished or noticed by a consumer at the point of a retail sale. For example, with a wedge-type golf club, the design of the sole and the rear surface of the club may specially sculpted to favor either a more vertical swing or shallow swing, or to allow the club face to have a variable loft angle simply by rotating the club along the shaft axis. Such differences may be hard to visually recognize for even an experienced golfer.

SUMMARY

A golf club having improved visual feature recognition includes a golf club head coupled to a golf club shaft. The golf club head includes a hosel defining a bore, a sole, and a design attribute that is generally not capable of easy visual discernment. The bore has a first portion having a first diameter, a second portion having a second diameter that is smaller than the first diameter, and a transition from the first diameter to the second diameter. The bore extends through the golf club head to the sole, and the golf club shaft is disposed within the first portion of the bore and secured to the hosel.

To provide improved visual recognition, a polymeric plug is disposed within the bore between the golf club shaft and the sole. The polymeric plug includes a restraining feature that contacts the transition to prevent withdrawal of the polymeric plug through the sole, and is a color that corresponds to the design attribute.

A method of constructing this golf club head begins by providing a golf club head that has a bore adapted to receive a golf club shaft. The bore extends through the golf club head between a hosel end and a sole, and the golf club head has a plurality of design attributes that are not capable of easy visual discernment.

A polymeric plug is selected that has a color correspond to at least one of the plurality of design attributes. The polymeric plug is inserted into the bore from the hosel end such that a portion of the plug extends proud of the sole. Once fully inserted, this proud portion is removed by cutting or grinding. The cut outer surface of the plug is then polished using a solvent or heat treatment. Finally, the polished portion of the polymeric plug is outwardly visible to provide an indication of the at least one of the plurality of design attributes.

The above features and advantages and other features and advantages of the present invention are readily apparent from the following detailed description of the best modes for carrying out the invention when taken in connection with the accompanying drawings.

DETAILED DESCRIPTION

Figure 1:
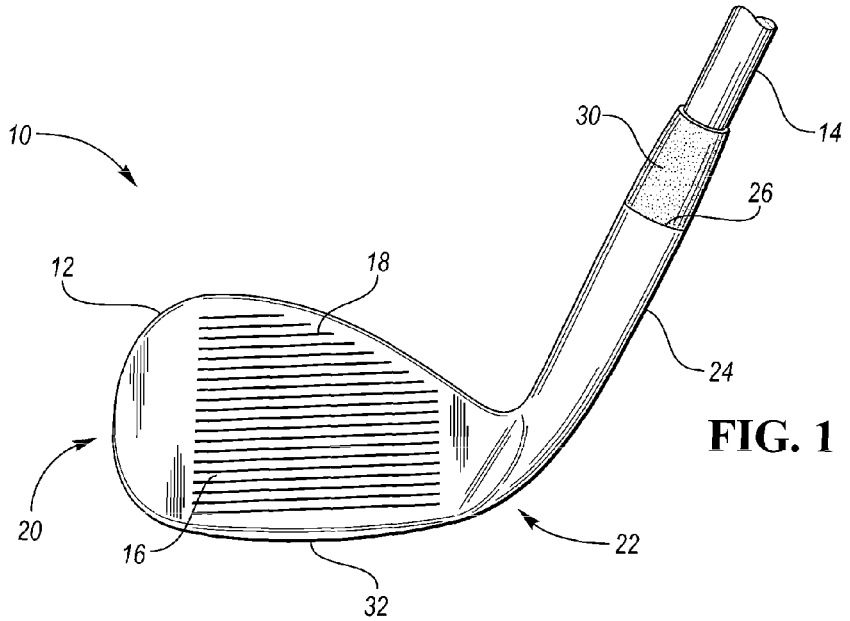
FIG. 1 is a schematic perspective view of the face of a golf club.

Referring to the drawings, wherein like reference numerals are used to identify like or identical components in the various views, FIG. 1 schematically illustrates a golf club 10 that includes a club head 12 mounted on the end of an elongate shaft 14. The shaft 14 may be gripped by a user and swung to impart a generally arcuate motion to the club head 12 for the purpose of impacting a golf ball.

The club head 12 includes a face 16 that is intended to contact the golf ball during a normal swing. The face 16 generally includes a plurality of parallel grooves 18 that are recessed into the club head 12 in a generally concave manner. As is commonly understood, the face 16 may be disposed at an angle to a vertical plane when the golf club 10 is held in a neutral hitting position. This angle may be generally referred to as the loft angle or slope of the club. Wood-type club heads (including hybrid woods) may most commonly have a loft angle of from about 8.5 degrees to about 24 degrees, while iron-type clubs may most commonly have loft angles from about 18 degrees to about 64 degrees, though other loft angles are possible and have been commercially sold. A particular subset of iron-type club heads, referred to as "wedges," may generally have loft angles of from about 45 degrees to about 64 degrees. The present technology may be of particular importance to iron-type club heads, including wedges.

The face 16 may generally separate a toe portion 20 of the club head 12 from a heel portion 22 of the club head 12. The heel portion 22 includes a hosel 24 that is operative to couple the club head 12 with the shaft 14. In one embodiment, the hosel 24 may include a free, hosel end 26 that defines a bore 28 configured to directly receive the shaft 14 (shown best in FIGS. 4 and 5). In some configurations, a plastic ferrule 30 may surround the shaft 14 and abut the hosel 24 to provide a smoother transition from the hosel 24 to the shaft 14.

Figure 2:
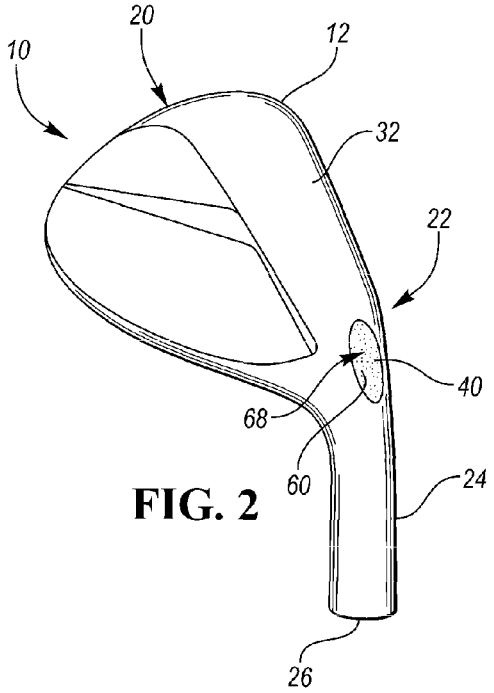
FIG. 2 is a schematic perspective view of the sole of a golf club.

The club head 12 further includes a sole 32 that extends on an underside of the club head 12 (i.e., where the sole 32 contacts the ground when the golf club 10 is held in a neutral hitting position). As generally shown in FIG. 2, the sole 32 may extend from the toe portion 20 to the heel portion 22, and may smoothly transition into the hosel 24, which is generally cylindrical in nature. The sole 32 may be disposed between the face 16 and a rear surface of the club head 12 that is opposite the face 16.

Figure 4:
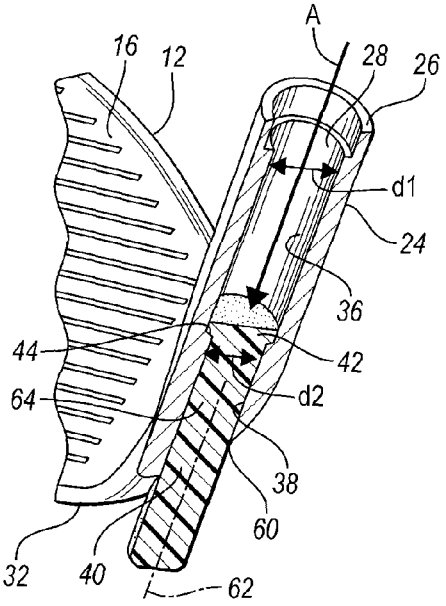
FIG. 4 is a schematic cross-sectional view of the golf club head of FIG. 2.

As generally shown in the cross-section provided in FIG. 4, in the present design, the bore 28 extends entirely through the club head 12 between the hosel 24 and the sole 32. Such a through-bore design provides a unique ability to redistribute mass from the heel portion 22 to the toe portion 20, which can increase the moment of inertia and forgiveness of the club head 12. In the present design, the bore 28 may include a first portion 36 having a first diameter d1 and a second portion 38 having a second diameter d2. The first portion 36 may be operatively configured (via the first diameter d1) to receive and retain the shaft 14, such as shown in FIG. 5.

The second portion 38 of the bore 28 may primarily serve a weight reducing function by removing about 800 $mm^3$ to about 1200 $mm^3$ of metal from the heel portion 22 (i.e., the approximate volume of the second portion 38 of the bore 28). Using typical club head materials, this results in a weight reduction of about 5 grams to about 8 grams, which is then available to be redistributed to the toe portion 20 of the club head 12 to more aptly align the center of gravity of the club head 12 relative to the geometric center of the face 16.

For example, in a wedge that weighs about 305 grams, a 7.5 mm diameter through-bore may remove from about 5 g to about 7 g of metal from the heel portion 22. In a wedge that originally has the center of gravity located about 2.5 mm from a vertical plane extending through the face center (i.e., on a heel side), providing the through-bore may translate the center of gravity toward the vertical plane by about 1.0 mm to about 1.2 mm. Adding this 5-8 grams of removed mass back to the toe portion 20 may then further translate the center of gravity toward the vertical plane by about 0.5 mm (a total translation of about 1.5 mm). By pushing the center of gravity away from the shaft, the moment of inertia of the club head is increased, without a corresponding increase in mass.

Figure 5:
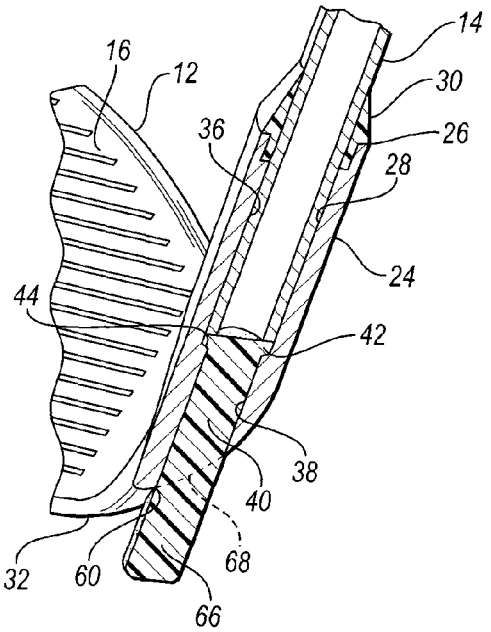
FIG. 5 is the schematic cross-sectional view of FIG. 3, with a golf club shaft secured within the hosel of the golf club head.

To prevent debris from becoming trapped in the second portion 38 of the bore 28 via the opening in the sole 32, a polymeric plug 40 is placed within the bore 28 such that it is disposed between the sole 32 and the shaft 14, as shown in FIGS. 4 and 5. To avoid reintroducing weight to the heel portion 22 of the club head 12, the polymeric plug 40 preferably has an average density that is less than about 20% of the density of the metal through which the bore 28 is formed. By keeping the density low, such as through the use of polymers, the weight contribution of the plug 40 should not significantly impact the center of gravity location of the club head. In one configuration, the polymeric plug 40 may be formed from an acrylic material, such as poly(methyl methacrylate), and may be either solid or partially hollow.

To prevent inadvertent removal, the polymeric plug 40 is designed such that it can only be inserted into the bore 28 via the hosel end 26 of the club head 12 (along translation direction A, shown in FIG. 4). In this manner, once the shaft 14 is inserted within the hosel 24, a portion 42 of the polymeric plug 40 may held captive between a restraining feature 44 of the bore 28 and the shaft 14. As generally shown in FIGS. 4 and 5, the restraining feature 44 of the bore 28 may be a ledge, chamfer, or bevel that is disposed between the first and second portions 36, 38 of the bore, such as where a larger, first diameter d1 reduces to a smaller, second diameter d2. The interfering portion 42 of the plug 40 may be dimensioned such that it can slidably pass within the first portion 36 of the bore 28, though is prevented from entering the second portion 38 through the physical interference of the restraining feature 44. Once the shaft 14 is inserted within the bore 28, this portion 42 of the plug 40 may then be pinned between the bore-feature 44 and the shaft 14 thus preventing any relative translation.

To prevent rotation of the plug 40 within the bore 28, a portion of the plug 40 may be dimensionally undersized relative to the second portion 38 of the bore 28. During installation, an adhesive may be disposed within the dimensional gap between the plug 40 and the bore 28, which may adhere the plug in place to prevent rotation. In an alternate embodiment, the plug may utilize its cross-sectional geometry so that the plug 40 can only be inserted in a discrete number of orientations, while being prevented from rotation once installed. For example, the plug 40 and bore 28 may have mating polygonal (or other non-circular) cross-sectional profiles, or may include a keyed attribute, or other similar feature.

In general, the present design provides a two-fold benefit: first, as noted above, the polymer-filled through-bore enables about 5 to 8 grams of mass to be relocated toward the toe portion 20 of the club head 12. This enables the center of mass of the club head to be more closely aligned with the geometric center of the face. As a secondary benefit, the polymeric plug (e.g., its color) may also serve as a quick visual indication of a particular feature of the golf club.

Figure 6A:
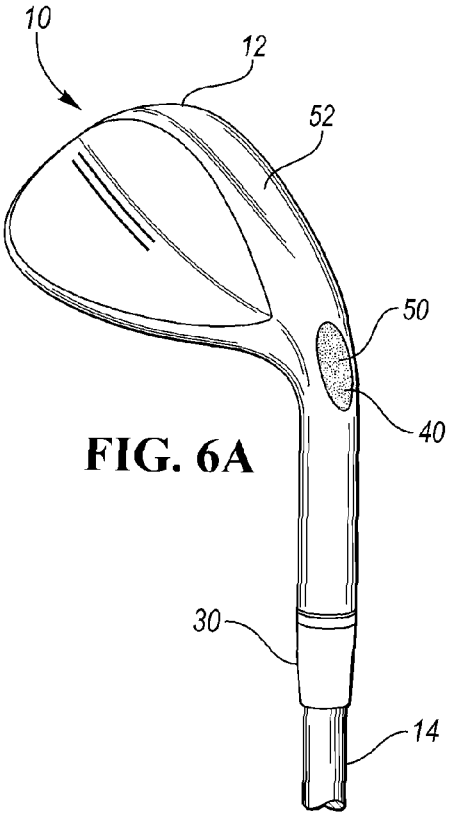
FIG. 6A is a schematic perspective view of a first golf club having a first sole profile and a polymeric plug of a first color.
Figure 6B:
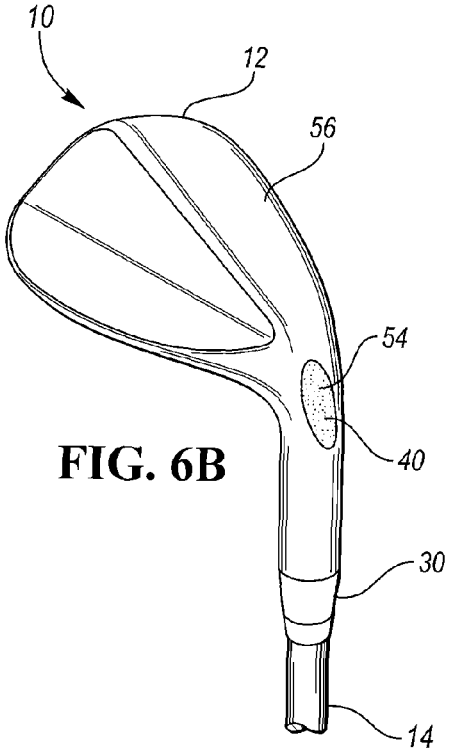
FIG. 6B is a schematic perspective view of a second golf club having a second sole profile and a second polymeric plug of a second color.

As with many golf club designs, the club head 12 may have one or more design attributes that are not capable of easy visual recognition. These design attributes may include aspects such as, for example, the sole profile, surface finish, metal type, mass distribution profile, or head construction. To aid in quickly identifying one or more of these features, the color of the polymeric plug may be selected to consistently correspond to one or more of the design attributes. For example, when used with wedges (i.e., a club with a loft angle from about 48 degrees to about 64 degrees), such as shown in FIGS. 6A and 6B, a plug 40 formed from a polymer of a first color 50 may correspond to a first sole profile 52 and a plug 40 formed from a polymer of a second color 54 may correspond with a second sole profile 56.

In the present design, the polymeric plug 40 may be homogeneously dyed or pigmented to the intended color. Unlike paint, or other topical appliques, by forming the entire plug 40 out of the pigmented polymer, scuffs or surface abrasions will not remove its identifying characteristics. During installation, having a pigmented plug 40 further simplifies assembly by eliminating the need to apply attribute-identifying indicia as a secondary process.

A method for constructing a golf club head 12 to achieve this improved, feature recognition and weight balance may begin by providing a golf club head 12 that has a bore 28 adapted to receive a golf club shaft 14. As shown in the cross-sectional views of FIGS. 4-5, the bore 28 should further extend through the club head 12 such that an opening 60 to the bore 28 is provided in the sole 32. Furthermore, the golf club head may have a plurality of design attributes that are not capable of easy visual discernment.

A polymeric plug 40 may then be selected that has a color chosen to correspond to at least one of the plurality of design attributes. As shown in FIG. 4, the polymeric plug 40 may have an elongate design that extends along a longitudinal axis 62. The polymeric plug 40 may include an elongate portion 64 that is dimensioned to extend within the second portion 38 of the bore 28 (i.e., the portion of the bore 28 closest to the sole 32), and a second portion 42 that is dimensioned to contact the restraining feature 44 of the bore 40. As shown in FIG. 4, this second portion 42 may be a cap-like portion that has a larger diameter than that of the elongate portion 64.

Figure 3:
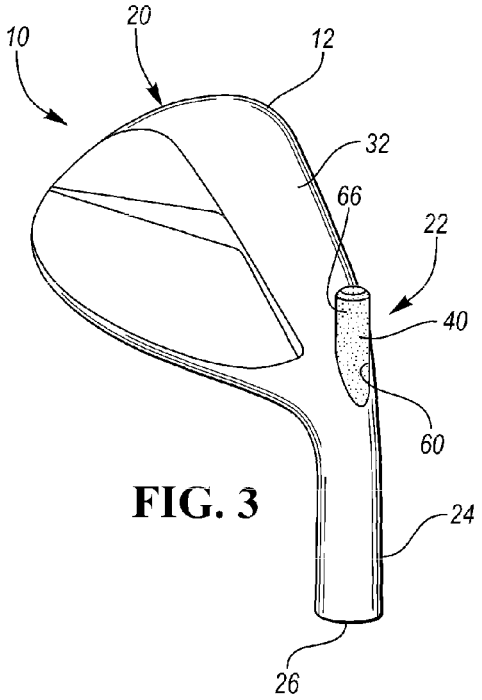
FIG. 3 is a schematic perspective view of a golf club head having a polymeric plug extending proud of the sole.

The polymeric plug 40 may be inserted into the bore 28 such that the elongate portion 64 of the plug 40 makes initial entry into the hosel end 26 of the bore 28 (i.e., along translation direction A). The plug 40 may be pushed down through the bore until the second portion 42 contacts the restraining feature 44 to prevent any further translation. Once fully inserted, a portion 66 of the plug 40 may extend proud of the sole 32 (i.e., where "proud" is intended to mean that the portion 66 protrudes beyond the surrounding surface), such as schematically shown in FIGS. 3 and 5. Said another way, the length of the elongate portion 64 of the plug 40 may be longer than a maximal dimension of the second portion 38 of the bore 28 such that when the plug 40 is fully inserted, a portion 66 of the plug 40 extends beyond the outer surface of the sole 32.

Following insertion, the proud portion 66 of the plug 40 may then be removed and/or cut flush with the sole 32, such as through a cutting or grinding process. In one embodiment, this process may be performed, for example, using a hot knife cutting tool. While it is possible to cut directly flush to the surface, in one embodiment, a small amount of the proud portion 66 may be left, which may be ground or buffed down to a contoured surface profile using a grinding or polishing wheel.

Following the removal of the proud portion 66, the cut, outer surface 68 of the plug 40 may be left with fine surface scratches which may alter the look, gloss, and/or color of the polymer. To remove these scratches, the outer surface 68 may be refinished/polished to restore it to a smooth profile. If the plug is formed from a thermoplastic polymer, the refinishing process may include locally heating the outer surface 68 to melt/reform the surface. If the plug 68 is formed from a thermosetting polymer, the refinishing process may include applying a solvent to the surface as a polishing procedure. For example, in one embodiment, the plug 40 may be formed from an acrylic material, such as poly(methyl methacrylate), and the solvent may include acetone.

Once refinished/polished, the smooth outer surface 68 should be outwardly visible to provide a clear indication of the design attribute it is intended to reflect. In one embodiment, this visibility may be improved through the inclined nature of the sole 32. Specifically, as shown in FIG. 2 and FIG. 5, the outer surface 68 of the plug 40 may be disposed at an oblique angle to the longitudinal axis 62 and/or to a cross-sectional plane that is transverse to the longitudinal axis 62. In one particular configuration, visibility is desirably improved if the surface area of the outer surface 68 is at least twice the size of the area of a cross-section that is transverse to the longitudinal axis 62. In one particular configuration, it is preferred if the surface area of the outer surface 68 of the plug is greater than about 80 $mm^2$.

The present means of visual identification may be particularly useful in improving retail product navigation. Specifically, a consumer may know that he or she hits "red" wedges better than "blue" wedges, where the different colors correspond to different sole profiles or weight characteristics. In some embodiments, product navigation signage (e.g., a retail display) may be placed adjacent to the club to serve as a legend or key for understanding the differences between the various color indicators. For example, a particular retail display may aid in visually correlating the first color 50 with a first design attribute (e.g., a first sole profile 52), and separately correlating the second color 54 with a second design attribute (e.g., a second sole profile 56).

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

What is claimed is:

1. A method of constructing a golf club head for improved visual feature recognition, the method comprising:

providing a golf club head having a bore adapted to receive a golf club shaft, wherein the bore extends through the golf club head between a hosel end and a sole, and wherein the golf club head has a plurality of design attributes;

selecting a polymeric plug having a color that corresponds to at least one of the plurality of design attributes;

inserting the polymeric plug into the bore from the hosel end such that a portion of the plug extends proud of the sole;

removing the proud portion of the plug by cutting or grinding;

polishing a portion of the polymeric plug that is flush with the sole using a solvent or head treatment; and wherein the polished portion of the polymeric plug is outwardly visible to provide an indication of the at least one of the plurality of design attributes.

2. The method of claim 1, further comprising restraining the polymeric plug from passing entirely through the bore by slidably contacting a feature of the polymeric plug and a corresponding restraining feature of the bore.

3. The method of claim 2, wherein the restraining feature of the bore includes a ledge, a chamfer, or a bevel disposed between a portion of the bore having a first diameter and a portion of the bore having a second diameter.

4. The method of claim 3, further comprising adhering a golf club shaft within the bore, wherein the golf club shaft prevents removal of the polymeric plug through the hosel end of the bore.

5. The method of claim 1, wherein the at least one of the plurality of design attributes includes a loft angle, a sole profile, a metal type, mass distribution profile, or a face milling pattern.

6. The method of claim 1, wherein the polymeric plug is formed from an acrylic material, and wherein the solvent includes acetone; and wherein polishing the portion of the polymeric plug using the solvent causes the portion of the polymeric plug to have a smoother surface finish.

7. A golf club having improved visual feature recognition, the golf club comprising:

a golf club head coupled to a golf club shaft, wherein the golf club head includes:

a hosel defining a bore, wherein the bore has a first portion having a first diameter, a second portion having a second diameter that is smaller than the first diameter, and a transition from the first diameter to the second diameter;

a sole; and a design attribute;

wherein the golf club shaft is disposed within the first portion of the bore and secured to the hosel, and wherein the bore extends through the golf club head to the sole;

a polymeric plug disposed within the bore between the golf club shaft and the sole, wherein the polymeric plug includes a restraining feature that contacts the transition to prevent withdrawal of the polymeric plug through the sole; and wherein the polymeric plug is a color that corresponds to the design attribute.

8. The golf club of claim 7, wherein a portion of the polymeric plug is disposed within the second portion of the bore; wherein the portion of the polymeric plug has a diameter that is smaller than the second diameter to accommodate an adhesive layer between the polymeric plug and the second portion of the bore; and wherein the golf club further comprises an adhesive disposed between the portion of the polymeric plug and the second portion of the bore.

9. The golf club of claim 7, wherein the transition includes a ledge, a chamfer, or a bevel.

10. The golf club of claim 7, wherein the design attribute is a loft angle, a sole profile, a metal type, mass distribution profile, or a face milling pattern.

11. The golf club of claim 7, wherein the polymeric plug is formed from an acrylic material.

12. The golf club of claim 7, wherein the golf club head is a wedge having a loft angle of from about 48 degrees to about 64 degrees; and wherein the design attribute is a sole profile.

13. The golf club of claim 7, wherein the second bore has a volume of from about 800 $mm^3$ to about 1200 $mm^3$.

14. The golf club of claim 7, wherein the polymeric plug has an exposed surface area that is flush with the sole, and wherein the polymeric plug has a cross-sectional area that is transverse to a central longitudinal axis of the plug; and wherein the exposed surface area is at least twice the size of the cross-sectional area to provide improved visual feature recognition.

15. The golf club of claim 7, wherein the exposed surface area is greater than 80 $mm^2$.

* * * * *